US005354451A

United States Patent [19]

Goldstein et al.

[11] Patent Number: 5,354,451

[45] Date of Patent: * Oct. 11, 1994

[54] FIXED-BED/MOVING-BED TWO STAGE CATALYTIC REFORMING

[75] Inventors: Stuart S. Goldstein, Ewell, England; Paul W. Kamienski, Basking Ridge, N.J.; David W. Staubs, Morris Plains, N.J.; Gerrit S. Swart, Westfield, N.J.; George A. Swan, III, Baton Rouge, La.

[73] Assignee: Exxon Research and Engineering Company, Florham Park, N.J.

[ * ] Notice: The portion of the term of this patent subsequent to Jun. 22, 2010 has been disclaimed.

[21] Appl. No.: 805,360

[22] Filed: Dec. 9, 1991

[51] Int. Cl.[5] ..... C10G 35/04

[52] U.S. Cl. ..... 208/65; 208/63; 208/64

[58] Field of Search ..... 208/65

[56] References Cited

U.S. PATENT DOCUMENTS

| | | | |
|---|---|---|---|
| 3,640,818 | 2/1972 | Hamner | 208/65 |
| 3,748,255 | 7/1973 | Cassidy et al. | 208/65 |
| 3,748,256 | 7/1973 | Koetz | 208/65 |
| 3,748,259 | 7/1973 | Cassidy et al. | 208/65 |
| 3,864,240 | 2/1975 | Stone | 208/65 |
| 3,883,418 | 5/1975 | Drehmann | 208/65 |
| 3,992,465 | 11/1976 | Juguin et al. | 208/65 |
| 4,155,843 | 5/1979 | Gallagher | 208/65 |
| 4,167,473 | 9/1979 | Sikonia | 208/64 |
| 4,206,035 | 6/1980 | Hutson, Jr. et al. | 208/65 |
| 4,737,262 | 4/1988 | Franck et al. | 208/65 |
| 4,808,457 | 2/1989 | Nyan | 208/65 |
| 4,832,821 | 5/1989 | Swan, III | 208/65 |
| 4,872,867 | 10/1989 | Clem | 208/65 |
| 4,975,178 | 12/1990 | Clem et al. | 208/65 |
| 4,985,132 | 1/1991 | Moser et al. | 208/65 |
| 4,992,158 | 2/1991 | Schweizer | 208/65 |

*Primary Examiner*—Helane Myers
*Attorney, Agent, or Firm*—Henry E. Naylor

[57] ABSTRACT

A two stage process for catalytically reforming a gasoline boiling range hydrocarbonaceous feedstock. The reforming is conducted in two stages wherein the first stage is operated in a fixed-bed mode, and the second stage is operated in a moving-bed continual catalyst regeneration mode. A gaseous stream comprised of hydrogen and predominantly $C_4^-$ hydrocarbon gases are separated between stages. A portion of the hydrogen-rich gaseous stream is recycled and the remaining portion along with the $C_5^+$ stream are sent to second stage reforming.

7 Claims, 1 Drawing Sheet

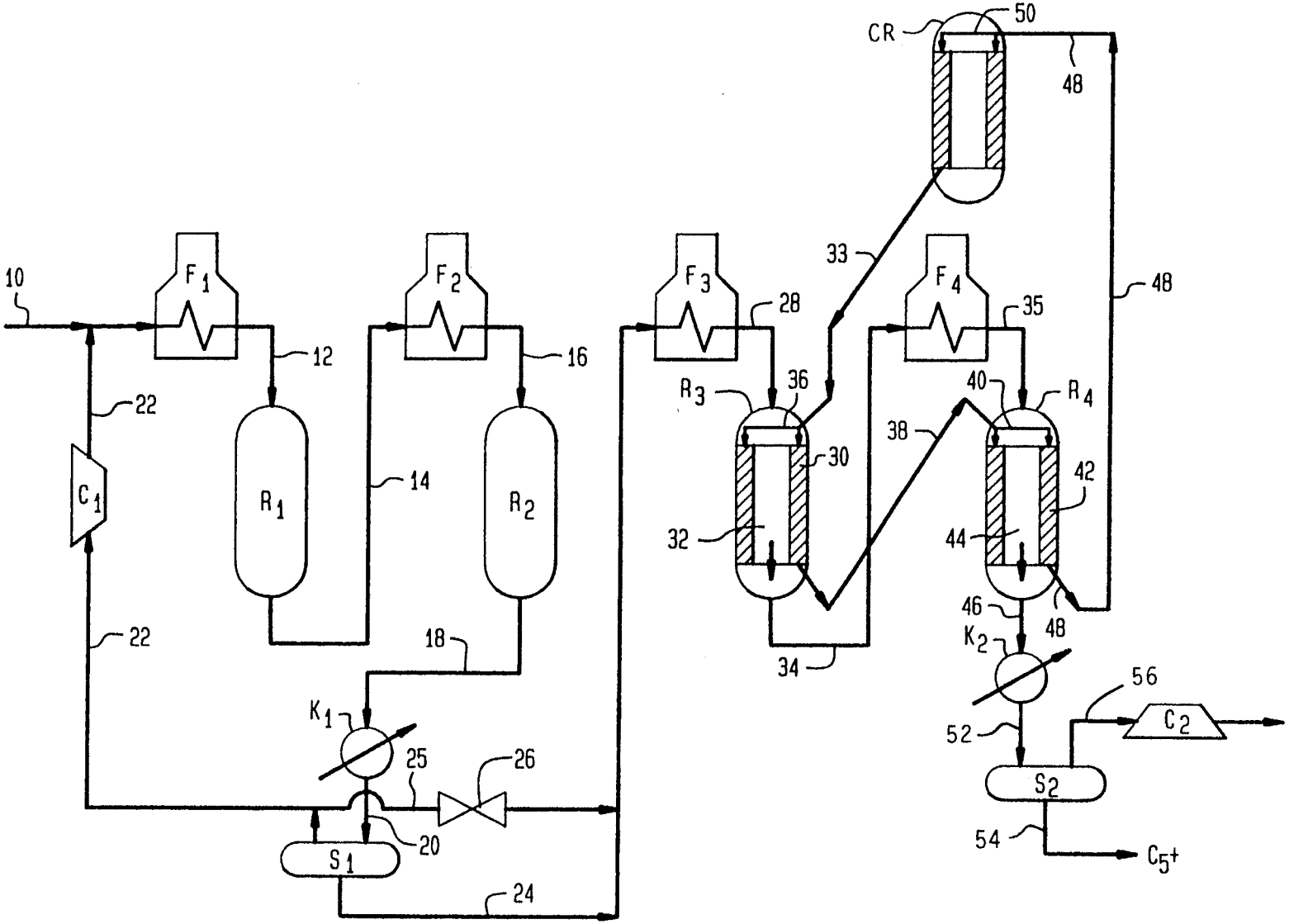
10
12
14
16
18
20
22
22
24
25
26
28
30
32
33
34
35
36
38
40
42
44
46
48
48
50
52
54
56
CR
F1
F2
F3
F4
R1
R2
R3
R4
C1
K1
K2
S1
S2
C2
C5+

FIXED-BED/MOVING-BED TWO STAGE CATALYTIC REFORMING

FIELD OF THE INVENTION

The present invention relates to a two stage process for catalytically reforming a gasoline boiling range hydrocarbonaceous feedstock. The reforming is conducted in two stages wherein the first stage is operated in a fixed bed mode, and the second stage is operated in a moving-bed continual catalyst regeneration mode. A gaseous stream comprised of hydrogen and predominantly $C_4-$ hydrocarbon gases are separated between stages and at least a portion of it is recycled.

BACKGROUND OF THE INVENTION

Catalytic reforming is a well established refinery process for improving the octane quality of naphthas or straight run gasolines. Reforming can be defined as the total effect of the molecular changes, or hydrocarbon reactions, produced by dehydrogenation of cyclohexanes, dehydroisomerization of alkylcyclopentanes, and dehydrocyclization of paraffins and olefins to yield aromatics; isomerization of substituted aromatics; and hydrocracking of paraffins which produces gas, and inevitably coke, the latter being deposited on the catalyst. In catalytic reforming, a multifunctional catalyst is usually employed which contains a metal hydrogenation-dehydrogenation (hydrogen transfer) component, or components, usually platinum, substantially atomically dispersed on the surface of a porous, inorganic oxide support, such as alumina. The support, which usually contains a halide, particularly chloride, provides the acid functionality needed for isomerization, cyclization, and hydrocracking reactions.

Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating the reaction stream as it passes from one reactor to another. There are three major types of reforming: semi-regenerative, cyclic, and continuous. Fixed-bed reactors are usually employed in semi-regenerative and cyclic reforming, and moving-bed reactors in continuous reforming. In semi-regenerative reforming, the entire reforming process unit is operated by gradually and progressively increasing the temperature to compensate for deactivation of the catalyst caused by coke deposition, until finally the entire unit is shut-down for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series. In continuous reforming, the reactors are moving-bed reactors, as opposed to fixed-bed reactors, with continuous addition and withdrawal of catalyst. The catalyst descends the reactor in an annular bed and is passed to a regeneration zone where it is regenerated, the sent back to the reforming zone. This cycle is continuously repeated.

With the gradual phasing out of lead from the gasoline pool and with the introduction of premium grade lead-free gasoline in Europe and the U.S., petroleum refiners must re-evaluate how certain refinery units are run to meet this changing demand. Because catalytic reforming units produce product streams which represent the heart of the gasoline pool, demands are being put on these units for generating streams with ever higher octane ratings.

U.S. Pat. No. 3,992,465 teaches a two stage reforming process wherein the first stage is comprised of at least one fixed-bed reforming zone and the second stage is comprised of a moving-bed reforming zone. The teaching of U.S. Pat. No. 3,992,465 is primarily to subject the reformate, after second stage reforming to a series of fractionations and an extractive distillation of the $C_6$–$C_7$ cut to obtain an aromatic-rich stream.

While these process schemes have commercial promise, the partially reformed stream must still undergo a separation between stages to remove the heavier components before they can be passed to a low pressure stage. This is because reforming reactors operated in semiregenerative and cyclic modes cannot operate with a full range first stage product stream at low pressure and low hydrogen/oil ratio typified by such processes. A full range product stream at such conditions would cause too much carbon, or coke, to deposit on the catalyst, thus leading to rapid catalyst deactivation.

Therefore, there still remains a need in the art for improved reforming processes which can overcome such disadvantages.

SUMMARY OF THE INVENTION

In accordance with the present invention, there is provided a process for catalytically reforming a gasoline boiling range hydrocarbon reactant stream in the presence of hydrogen in a reforming process unit comprised of a plurality of serially connected reforming zones wherein each of the reforming zones contains a catalyst comprised of one or more Group VIII noble metals on a refractory support. The catalyst may be either monofunctional or bifunctional. The process comprises:

(a) reforming the reactant stream in a first reforming stage comprised of one or more serially connected reforming zones containing a fixed-bed of catalyst comprised of one or more Group VIII noble metals on a refractory support, which one or more reforming zones are operated at reforming conditions which includes a pressure of about 100 to 500 psig, thereby producing a first effluent stream;

(b) passing said first effluent stream to a separation zone wherein a hydrogen-rich predominantly $C_4-$ hydrocarbon gaseous stream and a predominantly $C_5-$ effluent stream; are produced (c) recycling a portion of the hydrogen-rich gaseous stream to said first reforming stage;

(d) reforming the $C_5+$ effluent stream with the remaining portion of the hydrogen-rich gaseous stream in a second reforming stage operated at a pressure which is at least about 50 psig lower than that of the first reforming stage, which second reforming stage is comprised of one or more serially connected reforming zones which are operated in a moving-bed continual catalyst regeneration mode wherein the catalyst descends through the reforming zone, exits, and is passed to a regeneration zone where any accumulated carbon is burned-off, and wherein the regenerated catalyst is recycled to the one or more moving-bed reforming zones.

In preferred embodiments, the Group VIII noble metal for catalysts in all stages is platinum.

In still other preferred embodiments of the present invention, the catalyst of the final stage is comprised of platinum and tin on substantially spherical alumina support particles.

In yet another preferred embodiment of the present invention, from about 50 to 85 vol. % of the hydrogen-rich gas separated between stages is recycled.

BRIEF DESCRIPTION OF THE FIGURE

The sole FIGURE hereof depicts a simplified flow diagram of a preferred reforming process of the present invention. The reforming process unit is comprised of a first stage which includes a lead reforming zone, which is represented by a lead fixed-bed reactor, and a first downstream fixed-bed reforming zone, which is represented by another fixed-bed reactor, which first stage is operated in semi-regenerative mode, but which may also be designed to operate in a cyclic mode. There is also a second stage which contains two serially connected moving-bed reforming zones in fluid communication with a regeneration zone, which reforming zones are represented by annular radial flow reactors wherein the catalyst continuously descends through the reactors and is transported to the regeneration zone, then back to the reactors, etc.

DETAILED DESCRIPTION OF THE INVENTION

Feedstocks, also sometimes referred to herein as reactant streams, which are suitable for reforming in accordance with the instant invention are any hydrocarbonaceous feedstocks boiling in the gasoline range. Nonlimiting examples of such feedstocks include the light hydrocarbon oils boiling from about 70° F. to about 500° F., preferably from about 180° F. to about 400° F., for example straight run naphthas, synthetically produced naphthas such as coal and oil-shale derived naphthas, thermally or catalytically cracked naphthas, hydrocracked naphthas, or blends or fractions thereof.

Referring to the sole Figure hereof, a gasoline boiling range hydrocarbon reactant stream, which is preferably first hydrotreated by any conventional hydrotreating method to remove undesirable components such as sulfur and nitrogen, is passed to a first reforming stage represented by heater or preheat furnaces, $F_1$ and $F_2$, and reactors $R_1$ and $R_2$. A reforming stage, as used herein, is any one or more of a particular type of reforming zone, in this FIGURE reactors, and its associated equipment (e.g., preheat furnaces etc.). That is, each reforming stage will contain one or more of the same type of reactor, for example, fixed-bed or moving-bed, but not both. The reactant stream is fed into heater, or preheat furnace, $F_1$, via line 10 where it is heated to an effective reforming temperature. That is, to a temperature high enough to initiate and maintain dehydrogenation reactions, but not so high as to cause excessive hydrocracking. The heated reactant stream is then fed, via line 12, into reforming zone $R_1$ which contains a catalyst suitable for reforming. Such a catalyst typically contains at least one Group VIII noble metal, preferably platinum, with or without a promoter metal, on a refractory support, preferably alumina. Reforming zone $R_1$, as well as all the other reforming zones in this first stage, are operated at reforming conditions. Typical reforming operating conditions for the reactors of this first fixed-bed stage include temperatures from about 800° to about 1200° F.; pressures from about 100 psig to about 500 psig, preferably from about 150 psig to about 300 psig; a weight hourly space velocity (WHSV) of about 0.5 to about 20, preferably from about 0.75 to about 5 and a hydrogen to oil ratio of about 1 to 10 moles of hydrogen per mole of $C_5+$ feed, preferably 1.5 to 5 moles of hydrogen per mole of $C_5+$ feed.

The effluent stream from reforming zone $R_1$ is fed to preheat furnace $F_2$ via line 14, then to reforming zone $R_2$ via line 16. Because reforming reactions are typically endothermic, the reactant stream must be reheated to reforming temperatures between reforming zones. The effluent stream from this first stage is sent to cooling zone $K_1$ via line 18 where it is cooled to condense a liquid phase to a temperature within the operating range of the recycle gas separation zone, which is represented in the Figure hereof by a separation drum $S_1$. The temperature will generally range from about 60° to about 300° F., preferably from about 80° to 125° F. The cooled effluent stream is then fed to separation zone $S_1$ via line 20 where a gaseous stream and a heavier liquid stream are produced. The preferred separation would result in a hydrogen-rich predominantly $C_4-$ gaseous stream and a predominantly $C_5+$ liquid stream. It is understood that these streams are not pure streams. For example, the separation zone will not provide complete separation between the $C_4-$ components and the $C_5+$ liquids. Thus, the gaseous stream will contain minor amounts of $C_5+$ components and the liquid stream will contain minor amounts of $C_4-$ components and hydrogen.

A portion of the gaseous stream, which can be characterized as being a hydrogen-rich $C_4-$ gaseous stream, is recycled, via line 22, to line 10 by first passing it through compressor $C_1$ to increase its pressure to feedstock pressure. About 40 to 90 vol. %, preferably about 50 to 85 vol. %, of the hydrogen-rich gaseous stream will be recycled. Of course, during start-up, the unit is pressured-up with hydrogen from an independent source until enough hydrogen can be generated in the first stage for recycle. It is preferred that the first stage be operated in semi-regenerative mode, although a cyclic mode can also be used.

The remaining hydrogen-rich predominantly $C_4-$ gaseous stream from separation zone $S_1$ is passed to the second reforming stage via pressure control valve 26 where pressure is reduced to the level required for second stage operation. The amount of pressure reduction will depend on the operating pressure of the second stage separation zone $S_2$ and the pressure drop in furnaces $F_3$ and $F_4$, reactors $R_3$ and $R_4$, and the connecting piping. The reduced pressure gas from line 25 is mixed with the $C_5+$ liquid which passes from separation zone $S_1$ through a level control valve (not shown) and the mixture is then passed via line 24 to furnace $F_3$.

The heated stream from furnace $F_3$ is passed to reforming zone $R_3$ via line 28, which is operated in a moving-bed continual catalyst regeneration mode. Reforming conditions for the moving-bed reforming zones will include temperatures from about 800° to 1200° F., preferably from about 800° to 1000° F.; pressures from about 30 to 300, preferably from about 50 to 150 psig; a weight hourly space velocity from about 0.5 to 20, preferably from about 0.75 to 6. Hydrogen-rich gas should be provided to maintain the hydrogen to oil ratio between the range of about 0.5 to 5, preferably from about 0.75 to 3. In the preferred embodiment, all of the hydrogen gas is supplied by the hydrogen-rich predominantly $C_4^-$ gaseous stream which passes through pressure control valve 26. Instances may exist in which the gas flowing from the first stage is insufficient to supply the needed hydrogen to oil ratio. This could occur if the feedstock to the first stage was highly paraffinic or had a boiling range which included predominantly hydrocarbons in the 6 to 8 carbon number range. In these instances, hydrogen would need to be supplied from external sources such as a second reforming unit or a hydrogen plant. An additional, but less preferred source of hydrogen would be from compressing and recycling stream 56. This option would require additional compressor or a larger capacity compressor $C_2$.

Such reforming zones, or reactors, are well known in the art and are typical of those taught in U.S. Pat. Nos. 3,652,231; 3,856,662; 4,167,473; and 3,992,465 which are all incorporated herein by reference. The general principle of operation of such reforming zones is that the catalyst is contained in a annular bed formed by spaced cylindrical screens within the reactor. The reactant stream is processed through the catalyst bed, typically in an out-to-in radial flow, that is, it enters the reactor at the top and flows radially from the reactor wall through the annular bed of catalyst 30 which is descending through the reactor, and passes into the cylindrical space 32 created by said annular bed. It exits the bottom of the reforming zone and is passed, via line 34, to furnace $F_4$, then to reforming zone $R_4$ via line 35. Again, as in reforming zone $R_3$, the reactant stream passes out-to-in radially through the catalyst bed and into the cylindrical space 44 defined by said annular bed of catalyst. The effluent stream from reforming zone $R_4$ is passed via line 46 to cooling zone $K_2$ where the temperature of the stream is dropped to about 60° to 200° F., preferably from about 80° to 125° F. It is then passed into separation zone $S_2$ via line 52 where it is separated into a light hydrogen-rich $C_4^-$ gaseous stream and a $C_5^+$ liquid stream. The $C_5^+$ stream is collected for blending in the gasoline pool via line 54, and the light hydrogen-rich $C_4^-$ gaseous stream is sent through compressor $C_2$ via line 56 and used as a product gas.

Fresh and/or regenerated catalyst is charged to reforming zone $R_3$ by way of line 33 and distributed in the annular moving-bed 30 by means of catalyst transfer conduits 36, the catalyst being processed downwardly as an annular dense-phase moving bed. The reforming catalyst charged to reforming zones $R_3$ and $R_4$ is comprised of at least one Group VIII noble metal, preferably platinum; and one or more promoter metals, preferably tin, on spherical particles of a refractory support, preferably alumina. The spherical particles have an average diameter of about 1 to 3 mm, preferably about 1.5 to 2 mm, the bulk density of this solid being from about 0.5 to 0.9 and more particularly from about 0.5 to 0.8. The annular moving bed of catalyst exits from the bottom section of reforming zone $R_3$ and is passed via line 38 to reforming zone $R_4$ where it is distributed into the annular moving catalyst bed 42 by transfer from conduits 40.

The catalyst of reforming zone $R_4$ descends through the zone where it exits and is passed to catalyst regeneration zone CR via line 48 and transfer conduit 50 where the catalyst is subjected to one or more steps common to the practice of reforming catalyst regeneration. The catalyst regeneration zone CR represents all of the steps required to remove at least a portion of the carbon from the catalyst and return it to the state needed for the reforming reactions occurring in reforming zone $R_3$. The specific steps included in CR will vary with the selected catalyst. The only required step is one where accumulated carbon is burned-off at temperatures from about 600° to 1200° F. and in the presence of an oxygen-containing gas, preferably air. Additional steps which may also be contained in the catalyst regeneration equipment represented by CR include, but are not limited to, adding a halide to the catalyst, purging carbon oxides, redispersing metals, and adding sulfur or other compounds to lower the rate of cracking when the catalyst first enters the reforming zone.

The regenerated catalyst is then charged to reforming zone $R_3$ via line 33 and the cycle of continuous catalyst regeneration is continued until the entire reforming unit (both stages) is shut down, such as for catalyst regeneration of first stage (fixed-bed) reforming, which if operated in a semi-regenerative mode would need to be regenerated from time to time by shutting off the feed and raising the reactors to regeneration temperatures in the presence of an oxygen-containing gas. It is to be understood that the catalyst in the moving-bed reforming and regeneration zones may not be constantly moving, but may only move intermittently through the system. This may be caused by the opening an closing of various valves in the system. Thus, the word "continuous" is not to be taken literally and the word "continual" is sometimes used interchangeably with "continuous".

The moving-bed zones of the second stage may be arranged in series, side-by-side, each of them containing a reforming catalyst bed slowly flowing downwardly, as mentioned above, either continuously or, more generally, periodically, said bed forming an uninterrupted column of catalyst particles. The moving bed zones may also be vertically stacked in a single reactor, one above the other, so as to ensure the downward flow of catalyst by gravity from the upper zone to the next below. The reactor then consists of reaction zones of relatively large sections through which the reactant stream, which is in a gaseous state, flows from the periphery of the interior of the reactor (although a reactor may be designed to have the reactant stream flow from the center to the periphery) to the center (or from the center to the periphery) interconnected by catalyst zones of relatively small sections, the reactant stream issuing from one catalyst zone of large section divided into a first portion (preferably from 1 to 10%) passing through a reaction zone of small section for feeding the subsequent reaction zone of large section and a second portion (preferably from 99 to 90%) sent to a thermal exchange zone and admixed again to the first portion of the reactant stream at the inlet of the subsequent catalyst zone of large section.

When using one or more reaction zones with a moving bed of catalyst, said zones as well as the regeneration zone, are generally at different levels. It is therefore necessary to ensure several times the transportation of the catalyst from one relatively low point to a relatively high point, for example from the bottom of a reaction zone to the top of the regeneration zone, said transportation being achieved by any lifting device simply called "lift" (not shown on the Figure hereof). The fluid of the lift used for conveying the catalyst may be any convenient gas, for example nitrogen or still for example hydrogen and more particularly purified hydrogen or recycle hydrogen.

Catalysts suitable for use in any of the reactors of any of the stages include both monofunctional and bifunctional, monometallic and multimetallic noble metal containing reforming catalysts. Preferred are the bifunctional reforming catalysts comprised of a hydrogenation-dehydrogenation function and an acid function. The acid function, which is important for isomerization reactions, is thought to be associated with a material of the porous, adsorptive, refractory oxide type which serves as the support, or carrier, for the metal component, usually a Group VIII noble metal, preferably Pt, to which is generally attributed the hydrogenation-dehydrogenation function. The preferred support for both stages of reforming is an alumina material, more preferably gamma alumina. It is understood that the support material for the second stage reforming must be in the form of particles which are substantially spherical in shape, as previously described. One or more promoter metals selected from metals of Groups IIIA, IVA, IB, VIB, and VIIB of the Periodic Table of the Elements may also be present. The promoter metal, can be present in the form of an oxide, sulfide, or in the elemental state in an amount from about 0.01 to about 5 wt. %, preferably from about 0.1 to about 3 wt. %, and more preferably from about 0.2 to about 3 wt. %, calculated on an elemental basis, and based on total weight of the catalyst composition. It is also preferred that the catalyst compositions have a relatively high surface area, for example, about 100 to 250 $m^2/g$. The Periodic Table of which all the Groups herein refer to can be found on the last page of Advanced Inorganic Chemistry, 2nd Edition, 1966, Interscience publishers, by Cotton and Wilkinson.

The acid function of the catalyst is typically provided by a halide component which may be fluoride, chloride, iodide bromide, or mixtures thereof. Of these, fluoride, and particularly chloride, are preferred. Generally, the amount of halide is such that the final catalyst composition will contain from about 0.1 to about 3.5 wt. %, preferably from about 0.5 to about 1.5 wt. % of halogen calculated on an elemental basis.

Preferably, the Group III noble metal, the most preferred which is platinum, will be present on the catalyst in an amount from about 0.01 to about 5 wt. %, calculated on an elemental basis, of the final catalytic composition. More preferably, the catalyst comprises from about 0.1 to about 2 wt. % platinum group component, especially about 0.1 to 2 wt. % platinum. Other preferred platinum group metals include palladium, iridium, rhodium, osmium, ruthenium and mixtures thereof.

By practice of the present invention, reforming is conducted more efficiently and results in increased hydrogen and $C_5+$ liquid yields. The first stage reactors are operated at conventional reforming temperatures and pressures in semiregenerative or cyclic mode while the reactors of the second stage are moving bed reactors operated substantially at lower pressures. Such pressures in the second stage may be from as low as about 30 psig to about 100 psig. More particularly, the downstream reactors can be operated in once-through gas mode because there is an adequate amount of hydrogen generated, that when combined with the hydrogen-rich gas stream from the first stage, is an adequate amount of hydrogen to sustain the reforming reactions taking place.

The second stage reactors, when operated in a once-through hydrogen-rich gas mode, permit a smaller product-gas compressor ($C_2$ in the Figure) to be substituted for a larger capacity recycle gas compressor. Pressure drop in the second stage is also reduced by virtue of once-through gas operation. Of course, the second stage reactors can be operated in a mode wherein the hydrogen-rich gas is recycled.

Various changes and/or modifications, such as will present themselves to those familiar with the art may be made in the method and apparatus described herein without departing from the spirit of this invention whose scope is commensurate with the following claims.

What is claimed is:

1. A process for catalytically reforming a gasoline boiling range hydrocarbon reactant stream in the presence of hydrogen in a reforming process unit comprised of a plurality of serially connected reforming zones wherein each of the reforming zones contains a reforming catalyst comprised of at least one Group VIII noble metal on a refractory support, which process comprises;

(a) reforming the reactant stream in a first reforming stage comprised of one or more serially connected reforming zones containing a fixed-bed of catalyst comprised of one or more Group VIII noble metals on a refractory support, which one or more reforming zones are operated at reforming conditions which includes a pressure of about 100 to 500 psig, thereby producing a first effluent stream;

(b) passing said first effluent stream to a separation zone wherein a hydrogen-rich predominantly $C_4-$ hydrocarbon gaseous stream and a predominantly $C_5+$ effluent stream; are produced (c) recycling a portion of the hydrogen-rich gaseous stream to said first reforming stage;

(d) reforming the $C_5+$ effluent stream, with the remaining portion of the hydrogen-rich gaseous stream, in a second reforming stage operated, in once-through hydrogen gas model and at a pressure which is at least about 50 psig lower than that of the first reforming stage, which second reforming stage is comprised of one or more serially connected reforming zones which are operated in a moving-bed continual catalyst regeneration mode, which catalyst is comprised of at one or more Group VII noble metals on substantially spherical refractory support particles, wherein the catalyst continually descends through the reforming zone, exits, and is passed to a regeneration zone where it is regenerated by burning-off at least a portion of any accumulated carbon, and wherein the regenerated catalyst is continually recycled back to the one or more reforming zones.

2. The process of claim 1 wherein the catalyst in each of the reforming zones of the first stage is comprised of about 0.01 to 5 wt. % platinum, and about 0.01 to 5 wt. % of at least one metal selected from the group consisting of iridium, rhenium, and tin.

3. The process of claim 1 wherein the catalyst of each of the reforming zones of the second stage is comprised of about 0.01 to 5 wt. % platinum, and 0.01 to 5 wt. % tin on said support particles.

4. The process of claim 3 wherein the amount of platinum and tin are each from about 0.1 to 2 wt. % and the spherical refractory support particles are comprised of alumina.

5. The process of claim 3 wherein the catalyst in each of the first stage reforming zones is comprised of about 0.01 to 5 wt. % platinum, and about 0.01 to 5 wt. % of at least one metal selected from the group consisting of iridium, rhenium, and tin.

6. The process of claim 1 wherein: (i) the first reforming stage contains 2 or 3 fixed-bed reforming zones, and (ii) the second reforming stage contains one or two moving-bed reforming zones, with the proviso that when two moving-bed reforming zones are employed, the catalyst descends through a first moving-bed reforming zone, is passed to a second moving-bed reforming zone where it descends through said second moving-bed reforming zone, then is passed to a regeneration zone where any accumulated carbon is burned-off, after which the regenerated catalyst is recycled to said first moving-bed reforming zone.

7. The process of claim 6 wherein: (i) the catalyst in each reforming zone of said first reforming stage is comprised of about 0.01 to 5 wt. % platinum, about 0.01 to 5 wt. % of at least one metal selected from the group consisting of iridium, rhenium, and tin; and (ii) the catalyst in each of the reforming zones of said second stage is comprised of about 0.1 to 2 wt. % platinum, and about 0.1 to 2 wt. % tin on substantially spherical alumina particles.

* * * * *